US012349779B2

(12) United States Patent
Jollet et al.

(10) Patent No.: US 12,349,779 B2
(45) Date of Patent: Jul. 8, 2025

(54) WIPER DEVICE FOR A RECEPTACLE CONTAINING A PRODUCT, NOTABLY A COSMETIC PRODUCT

(71) Applicant: L'Oreal, Paris (FR)

(72) Inventors: Frédéric Jollet, Clichy (FR); Gilles Baudin, Clichy (FR); Lycia Aoussat, Aulnay-sous-Bois (FR); Nicolas Duru, Clichy (FR)

(73) Assignee: L'Oreal, Paris (FR)

( * ) Notice: Subject to any disclaimer, the term of this patent is extended or adjusted under 35 U.S.C. 154(b) by 607 days.

(21) Appl. No.: 17/298,278

(22) PCT Filed: Nov. 20, 2019

(86) PCT No.: PCT/EP2019/081929

§ 371 (c)(1),
(2) Date: May 28, 2021

(87) PCT Pub. No.: WO2020/109104

PCT Pub. Date: Jun. 4, 2020

(65) Prior Publication Data

US 2022/0022625 A1 Jan. 27, 2022

(30) Foreign Application Priority Data

Nov. 29, 2018 (FR) ..... 1872062

(51) Int. Cl.
*A45D 34/04* (2006.01)
*A45D 40/26* (2006.01)

(52) U.S. Cl.
CPC ..... *A45D 34/046* (2013.01); *A45D 40/267* (2013.01); *A45D 2200/1072* (2013.01)

(58) Field of Classification Search
CPC .. A45D 40/268; A45D 40/267; A45D 34/047; A45D 34/046; B65D 51/32
See application file for complete search history.

(56) References Cited

U.S. PATENT DOCUMENTS 4,332,494 A * 6/1982 Kingsford ..... A46B 9/021 401/5
5,597,254 A * 1/1997 Vasas ..... A45D 40/267 401/122

(Continued)

FOREIGN PATENT DOCUMENTS

CA 2054893 A1 5/1992
CA 2397193 A1 3/2003

(Continued)

OTHER PUBLICATIONS

International Search Report and Written Opinion for International Application No. PCT/EP2019/081929, filed Nov. 20, 2019, mailed Jan. 3, 2020 (12 pages).

(Continued)

*Primary Examiner* — Nicholas D Lucchesi
*Assistant Examiner* — Jennifer Gill
(74) *Attorney, Agent, or Firm* — CHRISTENSEN O'CONNOR JOHNSON KINDNESS PLLC

(57) ABSTRACT

The wiper device designed to equip a receptacle containing a product, notably a cosmetic product, comprises a tubular body (12) and a wiper member (14) made as one piece with said tubular body. The wiper member (14) comprises at least one helical winding (28) coaxial with an axis of elongation X-X' of the tubular body and provided with a plurality of successive coils along said axis of elongation.

13 Claims, 2 Drawing Sheets

(56) References Cited

U.S. PATENT DOCUMENTS

| | | | | |
|---|---|---|---|---|
| 2002/0014252 | A1* | 2/2002 | Masuyama | A45D 34/048 132/218 |
| 2002/0059942 | A1 | 5/2002 | Neuner et al. | |
| 2010/0129133 | A1* | 5/2010 | De Laforcade | A46B 9/021 401/122 |
| 2018/0092451 | A1* | 4/2018 | Lefevre | A45D 34/04 |
| 2018/0344006 | A1* | 12/2018 | Tarling | B01F 33/254 |
| 2019/0357660 | A1* | 11/2019 | Schreiber | A45D 34/045 |

FOREIGN PATENT DOCUMENTS

| | | | |
|---|---|---|---|
| CN | 101686748 | A | 3/2010 |
| CN | 102458185 | A | 5/2012 |
| CN | 107072384 | A | 8/2017 |
| EP | 1 177 741 | | 2/2002 |
| FR | 2814727 | A1 | 4/2002 |
| FR | 2935877 | * | 3/2010 |
| JP | 2006311949 | A | 11/2006 |
| JP | 2010246723 | A | 11/2010 |
| WO | WO 2008/068271 | | 6/2008 |
| WO | WO 2016/156742 | | 10/2016 |

OTHER PUBLICATIONS

Search Report mailed Jun. 30, 2023, issued in corresponding Chinese Application No. 201980067613.8, filed Nov. 20, 2019, 3 pages.

* cited by examiner

WIPER DEVICE FOR A RECEPTACLE CONTAINING A PRODUCT, NOTABLY A COSMETIC PRODUCT

The present invention relates to a wiper device designed for equipping a device for packaging and applying a product, notably a cosmetic product.

The expression "cosmetic product" is understood to mean a product as defined in Directive 93/35/EEC of the European Parliament and of the Council of 30 Nov. 2009 relating to cosmetic products.

Conventionally, such a packaging and application device comprises a receptacle, for storing the cosmetic product, provided with a neck, and an applicator mounted removably between a position for withdrawing product contained in said receptacle and an application position in which the applicator is separated from said receptacle. The applicator comprises a member for applying the product, for example a mascara brush or an eye liner, which is immersed in the product contained in the receptacle in the position for withdrawing the applicator.

The wiper device, which comprises the wiper member, is arranged in the neck of the storage receptacle. Conventionally, the wiper member is produced in the form of an annular lip against which the application member rubs when the applicator is inserted inside the receptacle or withdrawn therefrom.

When the applicator is withdrawn from the receptacle, the amount of product remaining on the application member is thus measured out in a relatively precise manner.

The wiper device is generally produced from an elastically deformable material, for example from elastomer, such as to obtain a sufficiently flexible wiper member.

With this type of material, however, retention of the wiper device on the receptacle may not be sufficiently solid.

The present invention aims to remedy this drawback.

The present invention aims more particularly to propose a wiper device that makes it possible to obtain a good compromise between the flexibility necessary to perform the wiping function and the stiffness required for attaching onto the associated receptacle.

The present invention relates to a wiper device designed to equip a receptacle containing a product, notably a cosmetic product, comprising a tubular body attaching in the neck of said receptacle and a wiper member made as one piece with said attaching tubular body.

"Wiper member made as one piece with said tubular body" is understood to mean that the wiper member is produced in the form of one unit with the attaching tubular body, i.e. in the same material as this body.

According to a general feature, the wiper member comprises at least one helical winding coaxial with an axis of elongation of the attaching tubular body and provided with a plurality of successive coils along said axis of elongation. The coils are connected together in the circumferential direction.

With such a wiper device, it is possible to select a relatively stiff material for the attaching tubular body, such as to ensure satisfactory attaching in the neck of the associated receptacle while retaining a degree of flexibility for the wiper member obtained by virtue of its special design. The helical winding of the wiper member may be reversibly deformed and thus makes it possible to improve wiping quality by wiping the associated applicator over a great length with flexible scraping.

Moreover, the arrangement of the coils, one above the other if the helical winding is provided with two coils, or some above others if the winding is provided with more than two coils, further promotes the improvement in wiping quality.

In one embodiment, said helical winding of the wiper member extends at least in part inside the attaching tubular body. In this case, said helical winding may preferably be entirely arranged inside the attaching tubular body.

In the assembled position of the wiper device on the associated receptacle, this helical winding of the wiper member is thus not immersed in the product contained in the receptacle.

The attaching tubular body may comprise a first end face designed, in the assembled position of said wiper device on the receptacle, to face an end wall of said receptacle and a second end face opposite the first end face.

According to a particular advantageous design of the wiper member, said helical winding extends from the attaching tubular body axially on the side of the second end face of said body.

With the wiper member designed in this way, when the applicator is withdrawn from the receptacle the coils of said helical winding tend to relax, i.e. to move apart in the axial direction, which further promotes wiping of the applicator over a great length.

Even though this particular design of the wiper member is particularly advantageous, it is nevertheless possible, in a variant embodiment, to provide a reverse orientation of said helical winding such that it extends from the attaching tubular body axially on the side opposite the second end face of said body. In this case, however, the coils of said helical winding tend to compress and to bear one against the other, or some against others, which prevents the excess product on the applicator from passing freely between these coils.

Said helical winding of the wiper member may be connected to the attaching tubular body along a joining zone arranged at a non-zero distance from the first end face of said body.

In a particular embodiment, the attaching tubular body of the wiper device may comprise a wiper orifice of reduced passage cross section relative to that of the rest of said tubular body. This wiper orifice may open out on the first end face of the attaching tubular body. The inside diameter of said helical winding of the wiper member may be different from the passage cross section of the wiper orifice, namely greater or smaller than said passage cross section.

The attaching tubular body may comprise a wall extending radially inwards and from which extends said helical winding of the wiper member.

According to a preferred design of the wiper member said helical winding of the wiper member is provided with at least a plurality of coils that are non-contiguous in the free state, i.e. the non-stressed state. This promotes the flow of the excess product between the coils when the applicator is withdrawn from the associated receptacle. To this end, it is also possible to make provision for said helical winding of the wiper member to be formed solely from non-contiguous coils.

Alternatively, it is still, however, possible to make provision for a design of the wiper member in which some of the coils or all of the coils of said helical winding are contiguous in the free state.

In a particular embodiment, the wiper member comprises two helical windings coaxial with the axis of elongation of the attaching tubular body and each provided with a plurality of successive coils along said axis of elongation. These two helical windings may be arranged such as to obtain an alternation of the coils of one of the windings and the coils of the other winding in the axial direction. These windings may be identical or non-identical. Alternatively, it is possible to make provision for a single helical winding or, furthermore, more than two helical windings.

Said helical winding(s) of the wiper member may, for example, be a spring.

The invention also relates to a device for packaging and applying a product, notably a cosmetic product, comprising a receptacle for storing said product, and an applicator provided with at least one application member and mounted in a removable manner between a withdrawing position in which said application member is located inside the storage receptacle and an application position in which the applicator is separated from said receptacle.

The device also comprises a wiper device as defined previously fixed in the neck of the storage receptacle, the wiper device being traversed by said application member of the applicator when said applicator is separated from the storage receptacle, in order to allow measuring-out of the amount of product present on said application member.

The invention further relates to a method for manufacturing a wiper device as defined previously by moulding using a moulding impression produced by additive fabrication.

"Additive fabrication" is understood to mean any fabrication method based on the construction of the moulding impression layer by layer by means of the addition of material. The moulding impression may, for example, be fabricated by laser sintering.

The present invention will be better understood from studying the detailed description of one embodiment that is given by way of entirely non-limiting example and is illustrated by the appended drawings, in which:

FIGS. 1 to 4 show a wiper device, referenced 10 overall, provided to equip a receptacle for storing a product, notably a cosmetic product. The wiper device 10 is illustrated in a position that is presumed to be vertical.

Figure 1:
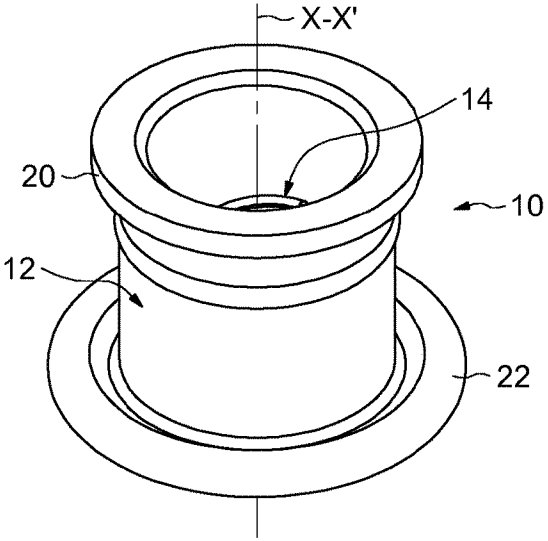
FIG. 1 is a perspective view of a wiper device according to an exemplary embodiment of the invention.
Figure 2:
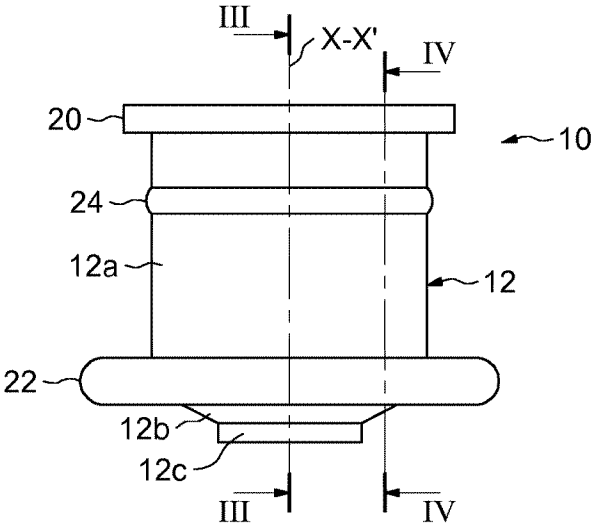
FIG. 2 is a front view of the wiper device of FIG. 1.
Figure 3:
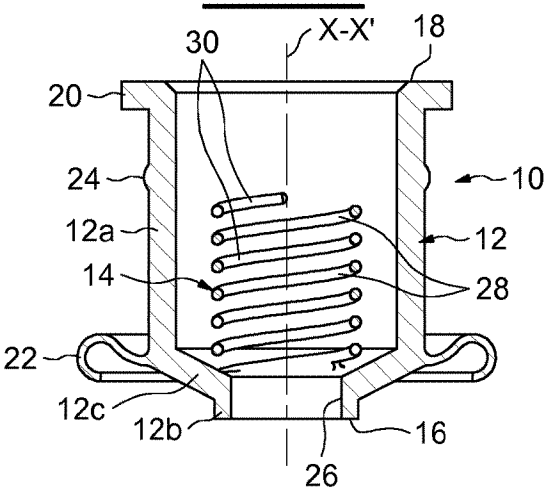
FIG. 3 is a sectional view on the axis III-III of FIG. 2.
Figure 4:
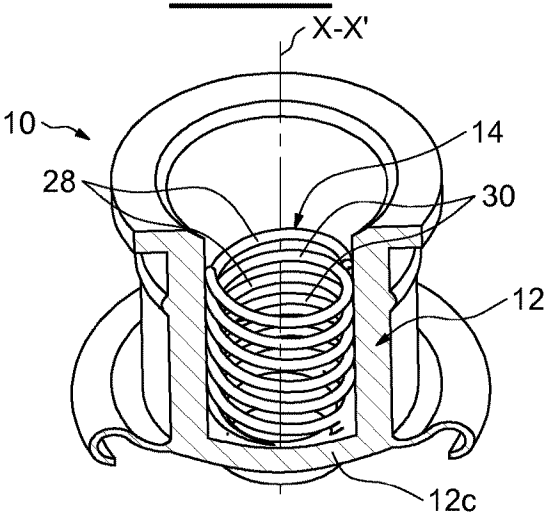
FIG. 4 is a perspective sectional view on the axis IV-IV of FIG. 2.

The wiper device 10 comprises an attaching tubular body 12, of longitudinal axis X-X', and a wiper member 14 extending from said body. The body 12 and the wiper member 14 are made as one piece. In other words, the body 12 and the wiper member 14 are produced as a single component. More generally, the wiper device 10 is produced as a single component, notably by means of moulding. By way of indication, the wiper device 10 may, for example, be made from a stiff material, for example PE.

As will be described in greater detail below, the wiper member 14 is designed such as to have a degree of flexibility irrespective of the stiffness of the material of the wiper device 10.

The tubular body 12 of the wiper device extends on the axis X-X'. The axis X-X' forms an axis of elongation of the body 12. The body 12 is delimited axially by a lower, first end face 16 and by a upper, second end face 18 opposite the first end face 16. The end faces 16, 18 form front faces of the body 12.

The body 12 has, here, a circular cross section. In a variant, the body 12 may have a cross section that is polygonal, notably a square cross section, or an oval cross section.

In the exemplary embodiment illustrated, the body 12 of the wiper device comprises a first axial portion 12*a* provided with the upper end face 18, a second axial portion 12*b* of reduced cross section and provided with the lower end face 16, and an intermediate portion or wall 12*c* connecting the axial portions 12*a*, 12*b*. The intermediate wall 12*c* extends between the axial portions 12*a*, 12*b*. In the exemplary embodiment illustrated, the intermediate wall 12*c* has a frustoconical form that extends radially inwards and axially downwards. Alternatively, it might be possible to provide an intermediate wall 12*c* that has another form, for example a purely radial form.

The body 12 of the wiper device comprises, furthermore, upper and lower radial collars 20, 22 provided such as to axially bear against the associated storage receptacle, as will be described in greater detail below. The collars 20, 22 are annular. The upper collar 20 extends the upper end face 18 of the body 12 radially outwards. The lower collar 22 extends the intermediate wall 12*c* of the body radially outwards. In the exemplary embodiment illustrated, the collar 22 has a form such that it is curved on itself. In a variant, the collar 22 may have other forms, for example a radial or oblique form. In a variant, it is also possible to omit this collar 22 on the body.

The body 12 of the wiper device further comprises a retention bead 24 extending radially outwards and provided such as to engage in a corresponding groove provided on the interior surface of the neck of the associated storage receptacle. The bead 24 is located on the exterior surface of the axial portion 12*a* axially below the collar 20 and axially in the vicinity thereof. The bead 24 is, here, of annular form. Alternatively, the bead 24 may be discontinuous in the circumferential direction. In a variant, it might also be possible to provide a plurality of retention beads.

The body 12 of the wiper device further comprises a wiper orifice 26. The wiper orifice 26 has a reduced passage cross section relative to that of the body 12. The intermediate wall 12*c* and the axial portion 12*b* delimit the wiper orifice 26. The wiper orifice 26 opens out on the lower end face 16.

The wiper member 14 comprises two helical springs 28, 30 extending from the body 12 and inside the latter. Each spring 28, 30 comprises a first end connected to the body 12 and a second, opposite end that is free, i.e. not connected to said body. The second free end of each spring 28, 30 is located axially on the side of the upper end face 18 of the tubular body.

The joining zone of each spring 28, 30 with the body 12 is arranged at a non-zero distance from the lower end face 16. In the exemplary embodiment illustrated, each spring 28, 30 extends from the intermediate wall 12*c* of the tubular body. Each spring 28, 30 extends axially inside the body 12 in the direction of the upper end face 18, while remaining at a non-zero distance therefrom. A radial annular space remains between each spring 28, 30 and the axial portion 12*a* of the tubular body.

The springs 28, 30 are concentric and coaxial relative to the axis X-X'. Each spring 28, 30 is provided with a plurality of turns or coils connected together in the circumferential direction and in succession along the axis X-X'. The coils of each spring 28, 30 are arranged axially one above another. In the exemplary embodiment illustrated, none of the coils of each spring 28, 30 are contiguous. The coils of the springs 28, 30 have a circular form, here, in cross section. In a variant, it is possible to provide other forms, for example rectangular, square, etc.

The winding direction of the springs 28, 30 is identical. The winding direction of the springs 28, 30 is, here, "to the left". The winding length of the springs 28, 30 is identical such as to achieve uniform wiping. The inside diameter and also the pitch of the springs 28, 30 are likewise identical. In the exemplary embodiment illustrated, the springs 28, 30 are thus identical to one another. The springs 28, 30 are arranged such that the coils of these two springs are arranged alternately along the axis X-X'.

Figure 5A:
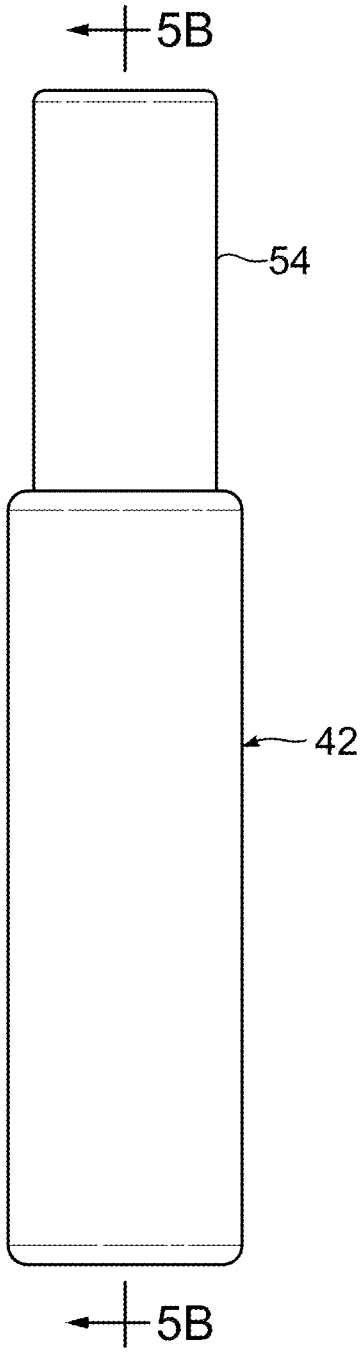
FIG. 5A is a side view of a packaging and application device equipped with the wiper device of FIG. 1.
Figure 5B:
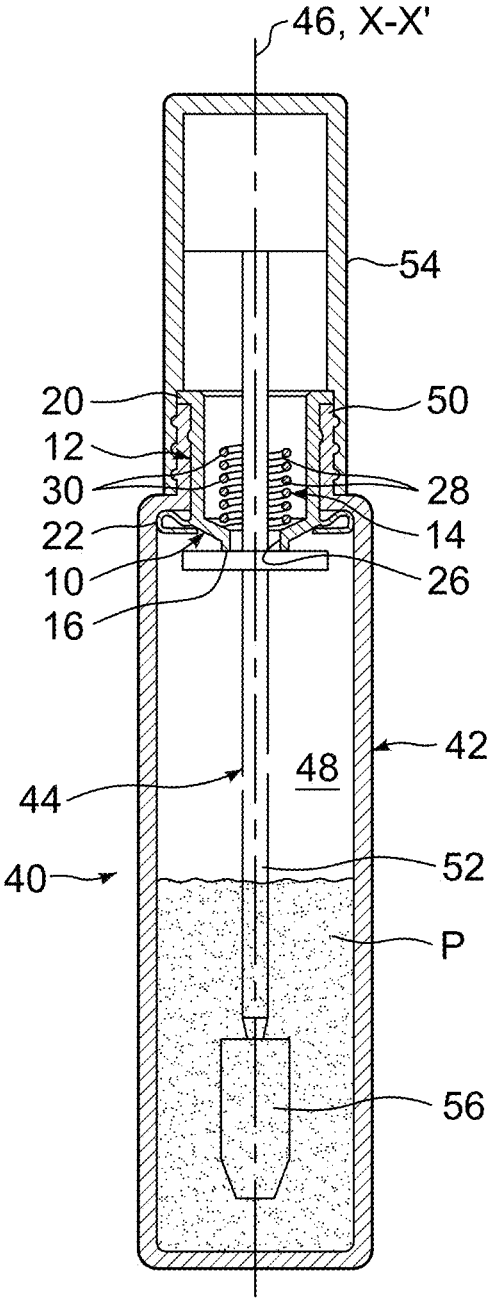
FIG. 5B is a cross-sectional side view of the packaging and application device of FIG. 5A.

FIG. 5 illustrates a device 40 for packaging and applying a cosmetic product P, which comprises a storage receptacle 42 containing said product and equipped with the wiper device 10, and an applicator 44 for the product.

The receptacle 42 extends on a geometrically longitudinal, in this case vertical, axis 46. The axis 46 of the receptacle is coaxial relative to the axis X-X' of the wiper device 10. The receptacle 42 delimits, within, an internal reservoir 48 for storing the cosmetic product P. The receptacle 42 comprises a lower end that forms an end wall and an opposite, open end that forms a neck 50. The neck 50 is separated from the perimeter of the receptacle by an annular shoulder. The free upper edge of the receptacle 42 delimits an access opening to the reservoir 48. More precisely, the neck 50 delimits this opening.

In the exemplary embodiment illustrated, the receptacle 42 has a circular cross section. In a variant, the receptacle 42 may have a cross section that is polygonal, notably square, or else an oval cross section.

The applicator 44 comprises a stem 52, a grip member 54 integral with the stem, and an application member 56 mounted at the free end of this stem.

The grip member 54 of the applicator is configured such as to form a cap suitable for removably closing the receptacle 42. In order to provide removable mounting on the receptacle 42, the grip member 54 here comprises a thread that engages with an outside thread on the neck 50 of the receptacle. Alternatively, it is possible to provide other types of removable securing, for example by clip-fastening.

The application member 56 is secured to the stem 52 on the side opposite the grip member 54. The stem is coaxial relative to the axis 46 of the receptacle. In FIG. 5, the application member 56 has been shown schematically. The application member 56 may, for example, be a moulded mascara brush or one that is formed from twisted branches between which bristles are held. Alternatively, the application member 56 may be provided for the application of types of product other than mascara, for example gloss or, furthermore, an eye liner. The application member 56 may thus have forms other than those of a brush or comb, for example the form of a straight or curved applicator tip.

The wiper device 10 is mounted in the neck 50 of the receptacle. In the assembled position, the end face 16 of the tubular body faces the receptacle. The tubular body of the wiper device 10 bears radially against the neck 50 of the receptacle. The upper collar 20 of the wiper device bears axially against the neck 24 of the receptacle. The lower collar 22 is located inside the reservoir 48 of the receptacle and bears axially against the shoulder thereof.

When the grip member 54 is in the position in which the receptacle 42 is closed, which also corresponds to a position for withdrawing the product the by means of the application member 56, a part of the stem 52 and a part of said application member 56 are located inside the reservoir 48 of the receptacle. The stem 52 of the applicator traverses the springs 28, 30 of the wiper member and the wiper orifice 26.

At the time of each use, the user secures the grip member 54 of the applicator of the receptacle 42 and withdraws the applicator 44 therefrom, using a substantially axial withdrawal movement. At the time of this withdrawal movement, excess product loaded on the application member 56 is removed as it passes through the springs 28, 30 of the wiper member 28 of the wiper device.

The inside diameter of the springs 28, 30 is chosen such as to touch at least the application member 52 upon withdrawal from the receptacle 42. The inside diameter of the springs 28, 30 is less than or equal to the outside diameter of the application member 52. The inside diameter of the springs 28, 30 is chosen as a function of the degree of wiping required from the application member.

Upon withdrawal of the applicator 14 from the receptacle, the coils of the springs 28, 30 move apart axially from one another, which promotes good wiping of the application member 56 of the applicator and the flow of excess product between these coils. Upon this withdrawal of the applicator 14, the springs 28, 30 thus deform through the action of the stress exerted by the application member 56. The springs 28, 30 then resume their initial position through elasticity once the applicator 14 has been totally withdrawn from the receptacle.

In the exemplary embodiment illustrated, the wiper orifice 26 of the wiper device has a diameter less than that of the springs 28, 30. Upon withdrawal of the applicator, the orifice 26 also contributes to wiping the application member 52. In the exemplary embodiment illustrated, the wiper orifice 26 has a diameter greater than that of the stem 52 of the applicator. Alternatively, the diameter of the wiper orifice 26 may be less than or equal to the outside diameter of the stem 52 such as to prevent the product contained in the receptacle 42 from escaping towards the outside.

In the exemplary embodiment illustrated, the wiper device lacks a wiper lip extending obliquely towards the stem 52 of the applicator. In a variant, it may be possible to provide a wiper device equipped, furthermore, with such a wiper lip. In such a case, the free end of this lip defines the wiper orifice.

The invention claimed is:

1. A wiper device, comprising:

an attaching tubular body; and a wiper member made as one single piece with said attaching tubular body, wherein the wiper device is configured to mount to a receptacle containing a product, wherein the attaching tubular body is configured to attach the wiper device into a neck of said receptacle, wherein the wiper member comprises at least one helical spring coaxial with an axis of elongation of the attaching tubular body and provided with a plurality of successive coils along said axis of elongation, wherein the successive coils of said at least one helical spring of the wiper member are connected together in the circumferential direction and are arranged axially one above another, wherein said at least one helical spring of the wiper member extends at least in part inside the attaching tubular body, a radial annular space remaining between an outer surface of said at least one helical spring and an inner bore of the attaching tubular body, the radial annular space extending along the entire length of the at least one helical spring, wherein said at least one helical spring of the wiper member comprises a free end which is not connected to the attaching tubular body.

2. A wiper device for a receptacle containing a product, comprising:

a tubular body for attaching the wiper device into a neck of the receptacle; and a wiper member, wherein the wiper device is produced as a single component, wherein the wiper member comprises at least one helical spring coaxial with an axis of elongation of the attaching tubular body and provided with a plurality of successive coils along said axis of elongation, wherein the successive coils of said at least one helical spring of the wiper member are spaced one relative to another in the axial direction, wherein said at least one helical spring of the wiper member extends at least in part inside the attaching tubular body and being provided with a first end connected to the attaching tubular body and with a second free end, the first end and the second free end delimiting the axial length of the at least one helical spring, wherein the tubular body comprises a first end face and a second end face opposite the first end face, the second free end of said at least one helical spring being located axially on the side of the second end face of the tubular body and remaining spaced apart from the tubular body.

3. A one single component wiper device configured to be mountable to a receptacle containing a product, the wiper device comprising:

a tubular body for attaching the wiper device into the neck of said receptacle; and a wiper member comprising at least one helical spring coaxial with an axis of elongation of the attaching tubular body and provided with a plurality of successive coils along said axis of elongation, wherein the wiper member and the tubular body are made as one piece with the same material, wherein the successive coils of said at least one helical spring of the wiper member are connected together in the circumferential direction and in succession along the axis of elongation, wherein said at least one helical spring of the wiper member extends at least in part inside the attaching tubular body, a radial annular space remaining between an outer surface of said at least one helical spring and an inner bore of the attaching tubular body, the radial annular space extending along the entire length of the at least one helical spring, wherein the tubular body comprises a wall extending radially inwards and from which issues said at least one helical spring of the wiper member, wherein the wall of the tubular body delimits a wiper orifice having a reduced passage cross section relative to that of said at least one helical spring of the wiper member.

4. The wiper device according to claim 1, wherein said at least one helical spring of the wiper member is arranged entirely inside the attaching tubular body.

5. The wiper device according to claim 1, wherein the attaching tubular body comprises a first end face and a second end face opposite the first end face, said at least one helical spring of the wiper member extending from the attaching tubular body axially on the side of the second end face of said attaching tubular body.

6. The wiper device according to claim 1, wherein said at least one helical spring of the wiper member is connected to the attaching tubular body along a joining zone arranged at a non-zero distance from a first end face of said attaching tubular body.

7. The wiper device according to claim 1, wherein the attaching tubular body comprises a wiper orifice of reduced diameter relative to that of the rest of said attaching tubular body.

8. The wiper device according to claim 7, wherein the wiper orifice opens out on a first end face of the attaching tubular body.

9. The wiper device according to claim 7 wherein the inside diameter of said at least one helical spring of the wiper member is greater than the diameter of the wiper orifice.

10. The wiper device according to claim 1, wherein the attaching tubular body comprises a wall extending radially inwards and from which extends said at least one helical spring of the wiper member.

11. The wiper device according to claim 1, wherein said at least one helical spring of the wiper member is formed by said plurality of non-contiguous coils.

12. The wiper device according to claim 1, wherein the at least one helical spring comprises two helical springs arranged such as to obtain an alternation of the coils of one of the windings with the coils of the other winding in the axial direction.

13. A device for packaging and applying a product, comprising: a wiper device according to claim 1, the wiper device fixed in the receptacle, wherein the receptacle is configured for storing said product, an applicator is provided with at least one application member and mounted removably between a withdrawing position in which said application member is located inside the receptacle and an application position in which the applicator is separated from said receptacle, and wherein the wiper device being traversed by said application member of the applicator when said applicator is separated from the receptacle.

* * * * *